US007145133B2

(12) United States Patent
Thomson

(10) Patent No.: US 7,145,133 B2
(45) Date of Patent: Dec. 5, 2006

(54) APPARATUS AND METHOD FOR MS$^{NTH}$ IN A TANDEM MASS SPECTROMETER SYSTEM

(75) Inventor: Bruce Thomson, Toronto (CA)

(73) Assignee: MDS Inc., Concord (CA)

( * ) Notice: Subject to any disclaimer, the term of this patent is extended or adjusted under 35 U.S.C. 154(b) by 207 days.

(21) Appl. No.: 10/433,473

(22) PCT Filed: Dec. 14, 2001

(86) PCT No.: PCT/CA01/01789

§ 371 (c)(1),
(2), (4) Date: Jun. 11, 2003

(87) PCT Pub. No.: WO02/48699

PCT Pub. Date: Jun. 20, 2002

(65) Prior Publication Data

US 2005/0098719 A1 May 12, 2005

Related U.S. Application Data

(60) Provisional application No. 60/255,121, filed on Dec. 14, 2000.

(51) Int. Cl.
*H01J 49/26* (2006.01)

(52) U.S. Cl. ..... 250/281; 250/282

(58) Field of Classification Search ..... None
See application file for complete search history.

(56) References Cited

U.S. PATENT DOCUMENTS 5,179,278 A 1/1993 Douglas
5,847,386 A 12/1998 Thomson et al.
6,011,259 A 1/2000 Whitehouse et al.
6,093,929 A 7/2000 Javahery et al.
6,111,250 A 8/2000 Thomson et al.
6,177,668 B1 1/2001 Hager
6,570,153 B1 5/2003 Li et al.

(Continued)

FOREIGN PATENT DOCUMENTS

CA 2274186 12/2000

(Continued)

OTHER PUBLICATIONS

Strife, R. J. et al., "Ion trap MS$^n$ genealogical mapping—approaches for structure elucidation of novel products of consecutive fragmentations of morphinans", Rapid Communications in Mass Spectrometry, 2000, pp. 250-260, vol. 14.

(Continued)

*Primary Examiner*—Jack I. Berman
(74) *Attorney, Agent, or Firm*—Bereskin & Parr

(57) ABSTRACT

A method and apparatus are provided for effecting multiple mass selection or analysis steps. Fundamentally, the technique is based on moving ions in different directions through separate components of a mass spectrometer apparatus. To effect different steps, a precursor ion is selected in a first mass selector, and then passed into a collision cell, to effect fragmentation or reaction with a gas, to generate fragment or product ions. The generated product ions are then passed back into the first mass selector, and preferably back into an upstream ion trap. The product ions then pass through the first mass selector again, to select a desired product ion, for further fragmentation and analysis. These steps can be repeated a number of times. A final mass analysis step can be effected in either a time-of-flight section or other mass analyzer. The invention enables conventional triple quadrupole mass spectrometers and QqTOF mass spectrometers to effect multiple MS steps.

52 Claims, 7 Drawing Sheets

U.S. PATENT DOCUMENTS 6,720,554 B1 4/2004 Hager

FOREIGN PATENT DOCUMENTS

WO WO 00/33350 6/2000

OTHER PUBLICATIONS

Chernushevich, I. V. et al., "Orthogonal Injection TOFMS for Analyzing Biomolecules", Analytical Chemistry News & Features, 1999, pp. 452A-461A.

Beaugrand, C. et al., "Proc. 34th ASMS Conference on Mass Spectrometry and Allied Topics", 1986, pp. 220-221.

10
12
14
SK
OR
40
1.5 Torr
16
18
Q0
IQ1
~10-2 Torr
550 L/s
42
22
50
20
Q1
~10-5 Torr
44
250 L/s
24
Q2
46
~10-2 Torr
IQ2
IQ3
550 L/s
26
34
FIELD-FREE
DRIFT REGION
4X10-7 Torr
32
30
28
36

APPARATUS AND METHOD FOR $MS^{NTH}$ IN A TANDEM MASS SPECTROMETER SYSTEM

FIELD OF THE INVENTION

This invention relates to mass spectrometry. This invention more particularly relates to tandem mass spectrometry and trapping of ions.

BACKGROUND OF THE INVENTION

Tandem mass spectrometry is a powerful analytical technique which is used for structural analysis of chemical species, as well as for the specific detection of known targeted compounds in the presence of many other compounds, or in samples which contain a wide variety of endogenous species which otherwise would obscure the presence of the compound of interest.

Mass spectrometry is a known instrumental technique in which compounds to be analyzed are first converted to ions (or, if already in the form of ions, are separated from the surrounding liquid), and then separated or filtered according to their mass-to-charge ratio (m/z), before being detected and counted with an ion or current detector. The output of such analysis is usually a mass spectrum in which the signal at each mass-to-charge value is proportional to the concentration of each species which has that m/z. Many modern ionization techniques (for example, electrospray and atmospheric chemical pressure ionization) form ions which are indicative only of the molecular weight of the species. Since there can be many different compounds of different structure but the same molecular weight, the mass value is only of moderate specificity in the analysis of an unknown species. In addition, if more than one species of the same m/z value is present in a mixture, then the signal will be the sum of the responses of both species together, and the individual concentration of each species cannot be unambiguously determined without use of another separation technique that does distinguish between the two species, such as chromatography (which separates species based on their elution time from a column) or other chemical separation method.

Tandem mass spectrometry is a technique in which ions of selected m/z can be fragmented at a controlled energy, usually by collisions with a low density gas. By selecting a narrow m/z range (eg. 1 amu wide) to be transmitted into the collision cell, and recording the mass spectrum of fragment ions by means of a second mass spectrometer placed after the collision cell, a tandem mass spectrum or mass fingerprint of the precursor ion is produced. This technique of fragmentation of a selected ion mass is called MS/MS. The process of fragmentation in a low density gas is called collisionally activated dissociation (CAD).

The MS/MS spectrum shows fragments of the precursor ion which are characteristic of its structure. The MS/MS spectrum of an unknown compound can reveal information about its structure, and hence something about the identity of the compound. Even if the structure of the compound cannot be deduced from the MS/MS spectrum, the spectrum is at least a fingerprint which identifies the compound with much less ambiguity than does just the molecular weight. This fingerprint can be used to search for the presence of the compound in a complex mixture, or to confirm the presence of a specific compound whose MS/MS spectrum has been previously determined. "Libraries" of MS/MS spectra can be constructed and used to compare against unknown spectra in order to perform automated identification.

Structurally similar compounds often fragment in a similar fashion. Thus if one compound is related to another by having a methyl group substituted for a hydrogen atom, it is likely that the MS/MS spectra of the two compounds would have many fragments in common, even though the molecular weights differ by 14 Daltons. This relationship can provide a powerful tool to search for the presence of related compounds in complex mixtures, by searching for fragmentation patterns which have many peaks in common, or which have at least one peak in common. In other cases, the m/z of certain fragment ions will differ from that of the precursor ion by a fixed value, for example 18 units, indicating that both precursors lose the same neutral species during CAD. This provides another way of searching for the presence of related compounds in a complex mixture.

Another widely used advantage provided by tandem mass spectrometry is that if the instrument is tuned to pass or detect only specific product ions of specific precursor ion masses, then this can be used to screen complex samples for the presence of known compounds which have the selected precursor ion m/z and which form the selected product ion or ions. For example, it is known that the drug Reserpine (MW 608) forms a precursor ion of m/z 609 in an electrospray ion source, and that under CAD, some products of m/z 195 and 174 are formed. Therefore, in order to detect the presence of Reserpine in a sample (such as urine or blood serum), a tandem mass spectrometer can be tuned to pass only ions of m/z 609 into the collision cell, and to pass only ions of m/z 195 or 174 to the ion detector. Thus if a signal is received at both 195 and 174, there is little doubt that the target compound is present. The compound is identified by both the precursor ion mass (609) and the product ion masses (195 and 174). If only a single mass spectrometer were used to detect the presence of any ion of m/z 609, then the analysis would be more ambiguous, since many different compounds form ions of m/z 609. However, very few of these, (besides Reserpine) would form products of m/z 174 and 195.

Tandem mass spectrometers are therefore widely used to analyze complex samples for the presence of specific target compounds, and to measure how much of the target compound is present by recording the intensity of the ion signal at the corresponding precursor/product masses. For example, tandem mass spectrometers are commonly used for the analysis of biological fluids (such as blood and urine) for the presence of drugs and their metabolites. In cases where the targeted compounds are known, and the requirement is only to detect the presence and quantity of the drug, then the instrument is tuned to only transmit and respond to the specific precursor/product ion (this is called the multiple-reaction-monitoring or MRM mode). In other cases, it is desired to detect and identity the presence of related compounds (e.g. metabolites of the drug), and the instrument is used in a mode in which the entire product spectrum is obtained, or in which a spectrum of those precursor ions which form a specific (characteristic) product or which lose a characteristic neutral molecule (i.e. there is a fixed mass difference provided between the precursor ion and the selected product ion) is produced. The former scan mode is called a Precursor Ion Scan, and the latter is called a Neutral Loss Scan.

A common type of tandem mass spectrometer is a triple quadrupole. This is composed of a quadrupole mass filter (commonly designated as Q1) followed by a low pressure collision cell (again, commonly designated as Q2, as it usually includes a similar quadrupole rod set) filled with nitrogen or argon at a pressure of a few millitorr, followed by a second mass filter (Q3), followed by an ion detector. Ions must pass through the first mass filter, collision cell and second mass filter in order to be detected. In a Product Scan Mode, Q1 is tuned to the precursor m/z value of interest, and the second mass filter (Q3) is scanned to record an MS/MS spectrum. In a Precursor Scan Mode, Q1 is scanned while Q3 is fixed at a product ion of interest. In a Neutral Loss Scan mode, both quadrupoles are scanned with a fixed mass difference between them.

A second type of tandem mass spectrometer is a quadrupole/time-of-flight system (QqTOF). In this instrument, Q1 and Q2 are followed by a time-of-flight mass spectrometer, which provides higher mass resolution and mass accuracy than a quadrupole mass spectrometer. (In the acronym QqTOF, Q designates Q1 and q designates Q2, the lower case indicating that it is not a mass analyzer and TOF indicates a time-of-flight section.) It also allows quasi-simultaneous detection of all ions in an ion pulse which is admitted to the TOF section.

Another known and different type of tandem mass spectrometer is a quadrupole ion trap. In this device, all mass analysis is performed on ions which are trapped within a fixed volume (within quadrupole electrodes inside a vacuum system). Ions are trapped within a radio-frequency quadrupole field, and by changing the amplitude and waveform applied to the surrounding electrodes, ions can be isolated (to remove all but a selected m/z), fragmented (by collisions with a low density gas which fill the device), and then scanned to record a mass spectrum. Because all of the events occur in the same region of space, but sequentially in time (first filling the trap with ions, then isolating the precursor ion, then fragmenting the precursor ions, then recording the mass spectrum of the products), the ion trap is sometimes referred to as "tandem in time" as opposed to a triple quadrupole which is "tandem in space".

Another related type of tandem mass spectrometer is a Fourier Transform Mass Spectrometer (FTMS). This is composed of a Penning Ion Trap, with the trapping region formed by the combined action of a strong magnetic field and a static electrostatic field. As in a quadrupole ion trap, MS/MS can be performed by the "tandem-in-time" process.

MS/MS/MS (or $MS^3$) is an extension of the technique of MS/MS. In this case, fragment ions of a fragment ion are formed (second generation products). For example, the m/z 195 product ion from Reserpine can be selected and fragmented. This can provide further detailed information of the structure of m/z 195, or can be used as a second level confirmation of the identity of Reserpine (by requiring that the Product Ion Spectrum of 609, and Product Ion Spectrum of the 195 fragment, both match that of Reserpine). From an instrumental point of view, MS/MS/MS requires that the precursor ion be isolated (eliminating all other m/z values), then fragmented, then the m/z 195 ion isolated (eliminating all other fragment ions), then the 195 ion fragmented and its spectrum recorded. The process can, in principle, be repeated to perform any desired level of $MS^n$; however since signal-to-noise (S/N) decreases at each stage, it is usually only common to perform $MS^3$.

$MS^3$ is usually only possible in ion trap or FTMS mass spectrometers (see Strife et al in Rapid Commun. Mass Spectrom. 14, 250–260, 2000.). In an ion trap, for example, ions from the source are trapped, and all but the precursor ion of interest is expelled or ejected from the trap. As mentioned above, this is done by using an auxiliary voltage with a wide range of frequencies to resonantly excite the motion of all ions except the one to be kept in the trap, until all other m/z ions are ejected. The precursor ion is then fragmented by gently exciting the motion of the precursor ion, until it fragments through multiple collisions with the low density background gas. All of the products are trapped. Then, the isolation step is repeated, ejecting all except the product ion of interest (for example, m/z 195 product of Reserpine). The motion of the product ion is then excited until it fragments, again trapping all of the products. The population of product ions is then scanned out of the trap and detected in order to product a mass spectrum. The entire cycle described constitutes MS/MS/MS of 609/195/products. A similar process is used in FTMS in order to perform MS/1MS/MS. In both instruments, the process can be repeated to fragment one of the trapped second-generation product ions, in order to do $MS^4$ and higher order experiments.

In other types of tandem mass spectrometers, such as triple quadrupoles and QqTOF instruments, which perform MS/MS by means of two mass spectrometers which are separated in space, higher orders of MS can only normally be done by adding another collision cell and another mass spectrometer. For example, Beaugrand et. al. (Proc. $34^{th}$ ASMS Conference on Mass Spectrometry and Allied Topics, 1986, p220) describe a pentaquadrupole system for performing MS/MS/MS and related experiments. However, such configurations are complex and expensive, and are not commonly available. They also cannot reasonably be extended to higher levels of $MS^n$, due to the complexity and cost of the instrument and poor signal-to-noise ratios.

There are some recent methods which have been developed in order to allow $MS^n$ to be performed in a triple quadrupole or QqTOF-type of tandem mass spectrometer. For example, a co-pending Canadian patent application 2,274,186 by Lisa Cousins and Bruce Thomson, filed Jun. 10, 2000 and assigned to the assignee of the present application, describes a method of producing MS/MS/MS spectra by employing one or more excitation processes to the ion beam as it passes through the collision cell, and turning the excitation source on and off rapidly in order to statistically correlate second and third generation product ions with their precursors. This technique is relatively simple to implement, but it does not provide true MS/MS/MS because the precursor ions at each stage are not isolated from others. Therefore at low sample concentrations, the S/N of this method can be poor. It also does not allow unit mass resolution of the precursor ions, since the excitation signal can excite neighboring ions (within a few m/z values) to fragment, which complicates the spectrum. In addition, the method of excitation requires that a AC voltage supply be provided for the collision cell in order to radially excite the ions. This requires extra cost and complexity.

A further limitation of this method is that ion fragmentation for the second fragmentation stage is performed by radially exciting the motion of the trapped ions until they fragment through collisions. This excitation has to be carefully controlled in order that the ions not be excited too far and hit the rods. Generally, this type of excitation causes ions to be gently heated or excited, and to fragment through the lowest energy channels. The fragmentation spectrum which results is often different from the standard CAD spectrum obtained in a triple quadrupole or QqTOF mass spectrometer, and some high energy fragments may not be observed.

In U.S. Pat. No. 6,011,259, Whitehouse et al have described a method for MS/MS/MS in an orthogonal TOF system, by trapping ions in an RF quadrupole (containing a buffer gas at low pressure) in front of the TOF, and using auxiliary excitation to perform the steps of isolation and fragmentation in the 2-D trap. This is very analogous to the techniques used in a 3-D Paul trap as described above. After one or more steps of isolation and fragmentation (for MS/MS or $MS^n$), the ions are released from the trap for mass analysis in the TOF mass spectrometer. In PCT Application PCT/CA99/01142 Douglas et. al. describe a similar technique in the collision cell of a QqTOF system.

Another recently described method is in co-pending U.S. provisional application 60/219,684 by James Hager and Jeff Plomley, in which MS/MS/MS is provided in a configuration, and in which ions are trapped in a collision cell (2-D quadrupole), and then the precursor ion mass is isolated by changing the RF voltage on the collision cell. The isolated precursor ion is then ejected into the next quadrupole (Q3), and is fragmented during the passage into Q3 by a few collisions with the gas emanating from the collision cell. The product ions are trapped in Q3, and then mass selectively scanned out of Q3. The entire process provides MS/MS/MS capabilities. However, the resolution provided by the method of isolation of the primary product ions (by changing the RF level on the collision cell) is rather low (for example a window of a few m/z values in width). Also, the efficiency of fragmentation by passage through the region between the quadrupoles is only about 40%, and it is limited to $MS^3$, without the possibility of higher orders of $MS^n$.

The methods described above (except the last one) all require auxiliary AC voltages to be applied to an RF-only quadruple, in order to isolate and/or fragment the ions. This requires extra cost and complexity, and requires careful control of this voltage and frequency in order to accurately isolate the correct m/z value. Using this method of isolation it is also difficult to achieve unit mass resolution.

SUMMARY OF THE INVENTION

It is an object of the invention to provide the ability to generate MS/MS/MS and higher order ($MS^n$) spectra with a QqTOF instrument which is essentially unmodified or unchanged from a standard configuration. Therefore it will add additional capability without substantial cost. It is also an object of the invention to provide MS/MS/MS capability with the simple capability of unit mass resolution for selection of the precursor ion and selection of each stage of product ion, by using a quadrupole mass filter in a normal transmission mode to provide such selection. Therefore the accuracy of the data will be improved because if desired, only a single m/z value will be selected for fragmentation at each stage. This is an improvement over existing methods for isolation as described above. It is a further object of the invention to provide a method of MS/MS/MS in which the method of fragmentation is equivalent to that in a standard triple quadrupole or QqTOF collision cell (that is, axial acceleration into a high pressure collision cell), which is an improvement over all existing methods of exciting trapped ions to fragment by causing their radial motion to increase.

In accordance with a first aspect of the present invention, there is provided a method of analyzing ions, the method comprising:

(i) providing a stream of ions;

(ii) passing the ions along an ion path including a first mass selector, for selecting precursor ions and a collision cell for effecting one of fragmentation of the precursor ions and reaction of the precursor ions with a reaction gas, thereby to form product ions; and (iii) mass analyzing the product ions, wherein the method includes: reversing the direction of ion flow along the ion path, to cause the ions to pass into at least one of the first mass selector and the collision cell more than once, thereby effecting multiple steps of at least one of forming products ions and mass analyzing the product ions.

The method can include:

(a) first passing ions through a RF ion guide and operating the RF ion guide at a relatively high pressure;

(b) passing the ions into said mass selector for selection of said precursor ions;

(c) passing the ions back in the RF ion guide and causing the RF ion guide to function as said collision cell to effect one of fragmentation and reaction of said precursor ions to form said product ions; and (d) passing the product ions back into the mass selector for a final mass analysis step.

Alternatively, the method includes:

(a) subjecting the ions to a first mass selection step in said first mass selector, to select precursor ions;

(b) passing the precursor ions into said collision cell, to effect said one of fragmentation of the precursor ion and reaction of the precursor ion with the reaction gas, thereby to form said product ions;

(c) passing said product ions back into the first mass selector, and operating the mass selector to select desired product ions;

(d) passing the selected product ions back into the collision cell to effect at least one of fragmentation of the selected product ions and reaction of the selected product ions with the gas, thereby to form secondary product ions; and (e) effecting a final mass analysis step on the secondary product ions.

The final mass analysis step can be effected in a mass analyzer separate from the first mass selector, or the same as the first mass selector. Preferably, the final mass analysis step is effected in one of a time-of-flight instrument to provide a complete mass spectrum, a linear ion trap to provide a complete mass spectrum, and a mass filter providing detection of one or more selected masses.

Preferably, the method includes providing a first ion trap, passing the ions through the first ion trap into the first mass selector, and, in step (iv), passing the product ions back through the first mass selector into the first ion trap, and then passing the product ions from the first ion trap through the first mass selector into the collision cell.

Advantageously, the method includes in steps (a) and (b) providing a DC axial electric field within the collision cell to drive ions in a first direction and providing a potential at an exit of the collision cell to trap product ions therein; during step (c) providing an axial electric field to drive ions back out of the collision cell into the first mass selector to the first ion trap, while providing a potential between the first ion trap and the ion source to prevent further ions from the ion source entering the first ion trap; during at least step (d) maintaining an axial electric field in the collision cell to drive ions from the collision cell into the final mass analyzer.

Another aspect of the present invention provides a mass spectrometer apparatus, for analyzing ions and comprising:

(i) an ion source;

(ii) a first mass selector, for receiving ions from the ion source and for selecting a precursor ion;

(iii) a collision cell connected to the first mass selector, for receiving a precursor ion, and for effecting at least one of fragmentation and reaction of the precursor ion to generate product ions; and (iv) a DC power supply connected to the collision cell and the first mass selector, and adapted to provide potentials for at least one of: driving ions from the first mass selector into the collision cell, and driving ions from the collision cell back into the first mass selector.

BRIEF DESCRIPTION OF THE DRAWING FIGURES

For a better understanding of the present invention and to show more clearly how it may be carried into effect, reference will now be made, by way of example, to the accompanying drawings which show a preferred embodiment of the present invention and in which.

DESCRIPTION OF THE PREFERRED EMBODIMENT

Figure 1:
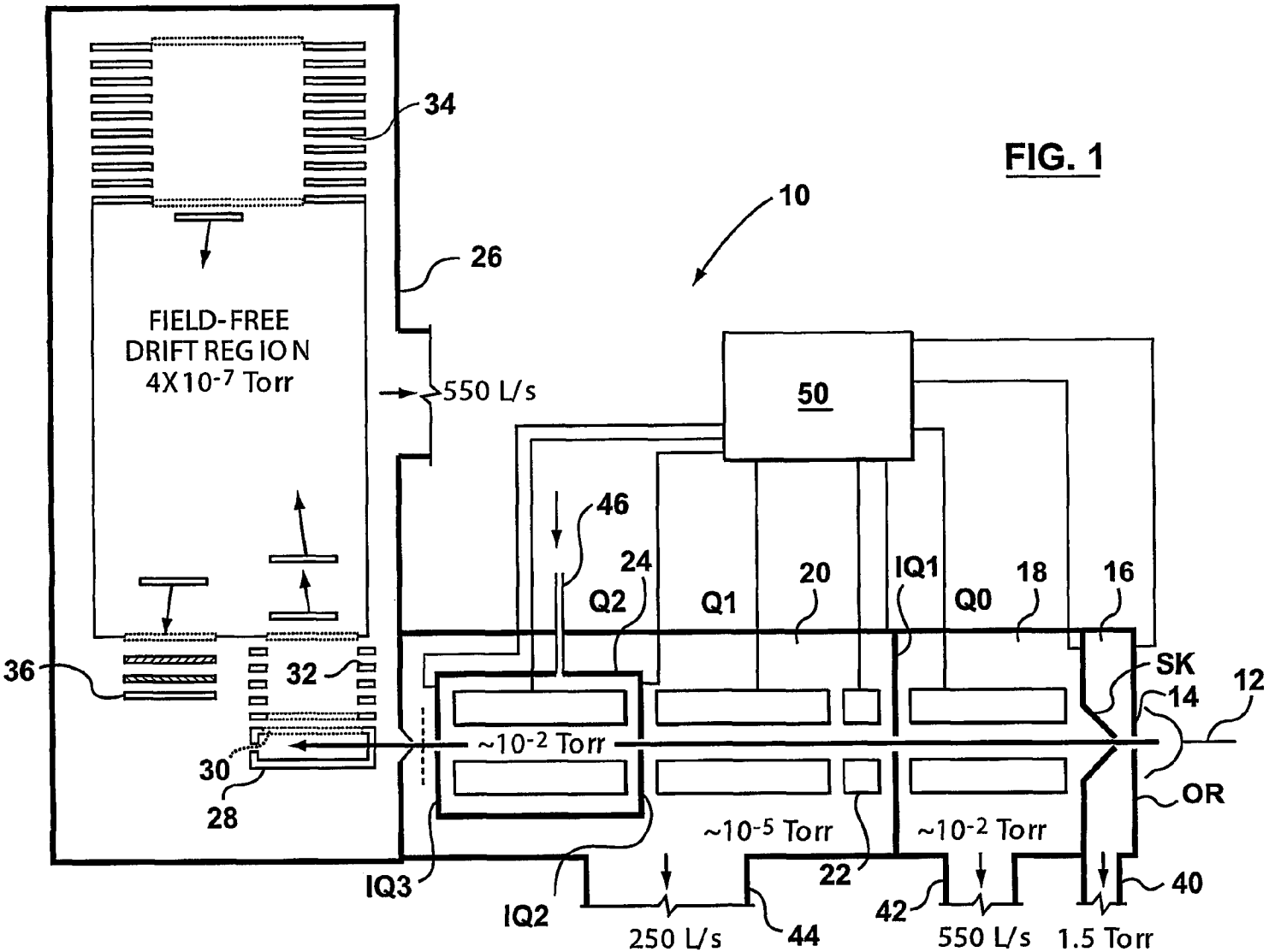
FIG. 1 is a schematic view of a QqTOF mass spectrometer.

FIG. 1 shows a schematic view of a conventional QqTOF tandem mass spectrometer, indicated generally at 10, (which has been described for example, by Chernushevich et al, Anal. Chem. 4, 7, 452A–461A, 1999). Ions are typically created in an ion source 12 by electrospray ionization or by atmospheric pressure ionization. The ions formed are sampled through a small orifice 14 into an intermediate pressure chamber 16, maintained at a pressure of about 1.5 Torr. The ions then pass into a first vacuum chamber 18, where they are captured by a first quadrupole rod set Q0, operated as an RF-only quadrupole, and the ions are then transmitted into a second vacuum chamber 20. The ions pass through a short quadrupole rod set or "stubbies", indicated at 22, into a second quadrupole rod set Q1 in the vacuum chamber 20. From Q1 the ions pass into a collision cell 24, housing a third quadrupole rod set Q2 (also an RF-only quadrupole) at low energy (in order to avoid fragmentation). The ions then pass into a time-of-flight (TOF) mass spectrometer 26. In known manner, ions are pulsed sideways by applying a brief voltage pulse between a plate 28 and a grid 30, driving ions into the acceleration region 32 of the TOF 26. Here the ions are accelerated to approximately 4 KV energy. They are reflected by the ion mirror 34 (which helps to compensate for their energy spread), and are then detected by a detector 36 which is connected to a time-to-digital converter (not shown) in order to accurately measure their flight time.

Many other components conventional for operation of the mass spectrometer are, for simplicity, not shown. For example, connections are indicated at 40, 42 and 44 for pumps, to maintain desired sub-atmospheric pressures, but details of the pumps are omitted. In addition to maintaining the intermediate pressure chamber 16 at a pressure of the order of 1.5 Torr, the first vacuum chamber 18 is typically maintained at a pressure of the order of $10^{-2}$ Torr and a second vacuum chamber 20 at a pressure of $10^{-5}$ Torr. Again as is known, an inlet 46 is provided for gas, for example, argon, for the collision cell 24. The collision cell 24 would then be maintained at a pressure of around $10^{-2}$ Torr.

As is also well known in this art, various RF and DC supplies would be provided, as required. Thus, Q0 is commonly operated as an RF-only quadrupole, and for this purpose, would simply require an RF power supply. For simplicity, the RF voltage for Q0 is often supplied by coupling Q0 to Q1 through capacitors, which produces an RF voltage on Q0 which is a constant fraction of that on Q1. This method is well known. The second quadrupole rod set Q1 can be operated in different modes, and commonly would be provided with power supplies capable of providing both RF and DC power. With just RF supplied, it operates in RF-only mode and transmits all ions uniformly over a wide mass range. With an additional DC component, it can operate in a mass selected mode. The short rod set 22 is provided with just RF power. The third quadrupole rod set Q2, in the collision cell 24, is commonly provided with just RF, so as simply to focus and transmit ions through to the TOF section 26.

Additionally, it is known to provide varying DC potentials along the length of the spectrometer, to control the flow of ions and kinetic energy of the ions. For example, the potential between the rod set Q1 and rod set Q2 can be adjusted, so as to adjust the energy of ions entering into Q2. In the present invention, the DC potential profile along the instrument as a whole, is an important aspect of the invention, and more importantly, distinct and unusual potential profiles are provided, in order to move ions between different quadrupole rod sets to effect desired ion processing; this is detailed below. In view of the importance of the potentials supplied to the different elements of the spectrometer, a power supply 50 is shown, connected to various elements, for controlling the DC potential thereof.

Thus, the power supply 50, which as indicated would supply independently controlled DC voltages to each lens element or rod set, is connected to the three main quadrupole rod sets Q0, Q1 and Q2, and also to the shorter "stubbies" rod set 22, that is also identified as ST. The power supply 50 is additionally connected to the orifice plate indicated at OR, including the orifice 14 and to a skimmer cone indicated as SK, providing the separation between the intermediate pressure chamber 16 and the first vacuum chamber 18. Further, there are three interquad apertures identified as IQ1, IQ2 and IQ3. IQ1 separates the first and second vacuum chambers 18, 20; IQ2 and IQ3 are provided at either end of the collision cell 24. These are also connected to the power supply 50.

Figure 2:
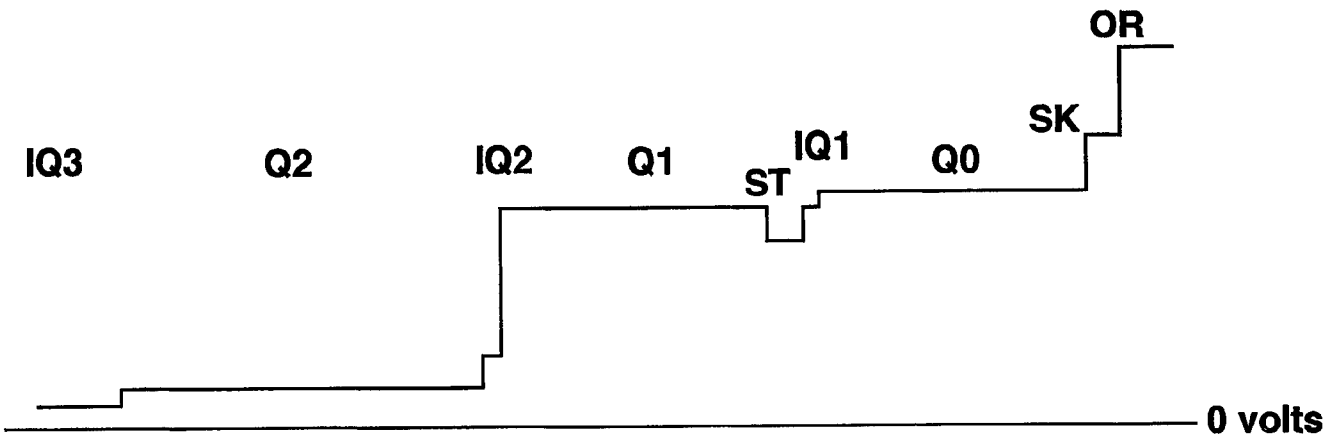
FIG. 2 is a graph showing schematically voltage levels on lens elements in the spectrometer of FIG. 1, in a conventional MS/MS mode.

In order to obtain an MS/MS spectrum, Q1 is switched to a mass resolving mode by applying a quadrupolar DC voltage so as to act as a first mass selection or analyzer, as is conventionally done in a quadrupole mass spectrometer. By adjusting the resolving DC voltage, the mass-selection window can be varied from 1 amu wide (so-called unit mass resolution) to 2 or 3 amu wide (so-called low resolution). The RF amplitude applied to Q1 determines the value of m/z to be transmitted. Ions which are selected by Q1 are accelerated into the collision cell 24 and rod set Q2 at energies of from 10 eV up to 200 eV as set by the power supply 50, depending upon the degree of fragmentation required. The ions fragment by collisions in Q2, and lose any residual energy through many more collisions with the collision gas which is at a pressure of about 10 millitorr. By the time the ions reach the exit from the collision cell, their axial energy is approximately thermal (i.e. much less than 1 eV). A small axial field can be applied in Q2 in order to move the ions toward the end, or the processes of diffusion and space charge can be relied on to ensure that all ions eventually leave the end of Q2. After the ions leave Q2, they are accelerated to approximately 10 eV before entering the TOF section. Typical DC voltages for this conventional mode of MS/MS are: OR=150, SK=50, Q0=40, IQ1=39, ST=34, Q1 rod offset=38, IQ2=15, Q2 rod offset=10, IQ3=9. FIG. 2 shows a schematic of the voltages used for each ion optic element.

Figure 3:
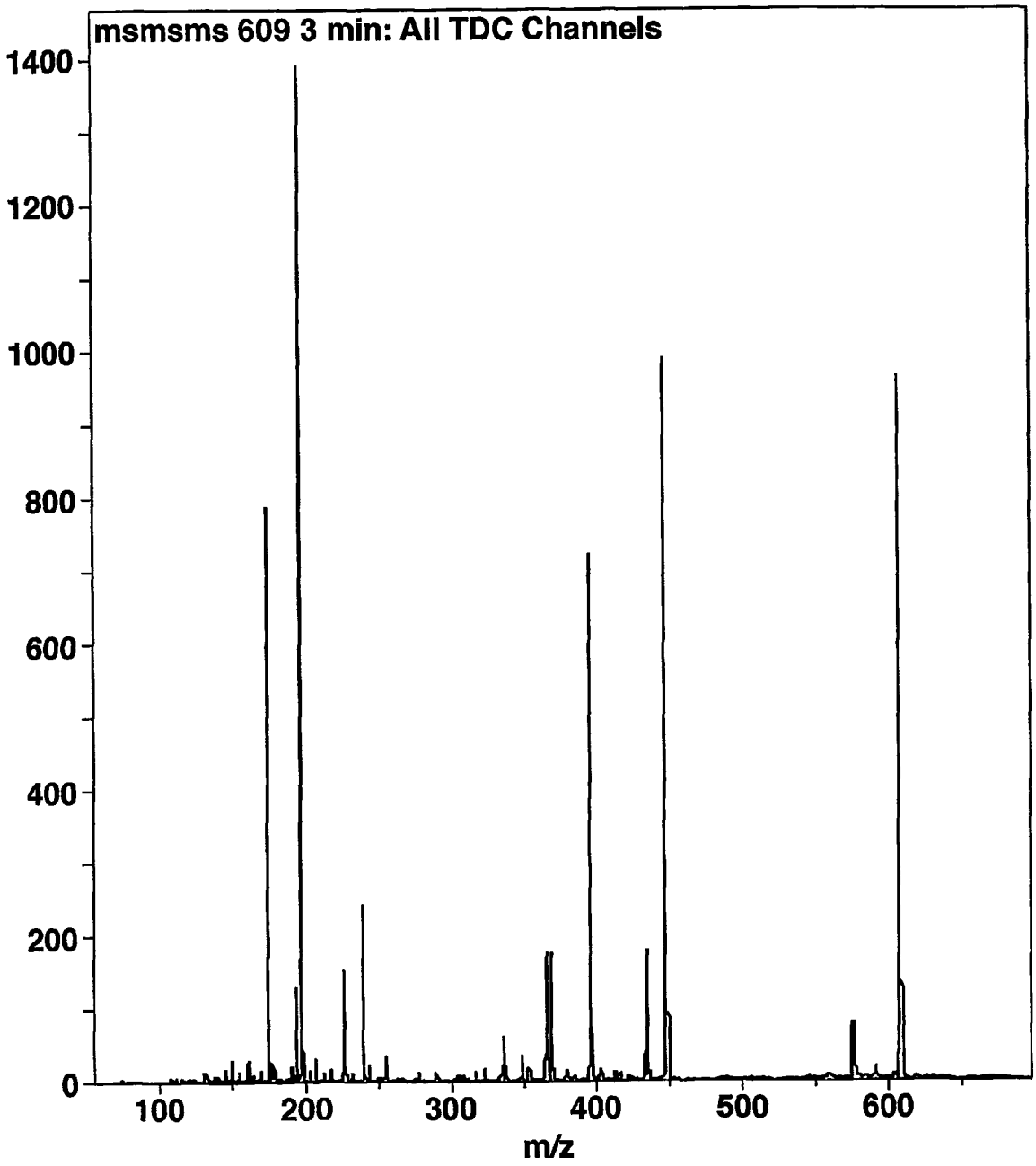
FIG. 3 shows an MS/MS spectrum for reserpine obtained from the spectrometer of FIG. 1.

FIG. 3 shows an MS/MS spectrum of m/z 609 (selected in Q1) from Reserpine under these conditions. The major fragment ions (product ions) of m/z 609 are m/z 448, 397, 195, 174.

In order to perform MS/MS/MS, and in accordance with the present invention, the applicant has discovered that product ions (after fragmentation) can be trapped in the collision cell (Q2), and then accelerated at low energy backward through Q1 into Q0, where they can be trapped again; the energy and potentials are sufficient to move the ions, but low enough that no fragmentation occurs. After transferring all of the product ions back to Q0, Q1 can be set to transmit one of the product ion m/z values, and then the ions can be passed back through Q1 and accelerated into Q2 at an energy sufficient to fragment the selected ion; the fragments can then be passed into the TOF for analysis. This produces an MS/MS/MS spectrum where the first two mass selection steps are performed by the quadrupole Q1, and the fragmentation is performed in the conventional manner of acceleration at a controlled energy into Q2 in the collision cell.

As an example of a typical MS/MS/MS experiment, consider m/z 609 from Reserpine as the original precursor ion from the ion source. The MS/MS spectrum of m/z 609 shows a series of peaks at m/z 174, 195, 397, 448, among other smaller peaks. If we wish to examine the structure of m/z 397 in more detail, we can perform MS/MS on m/z 397 from the 609 precursor.

Figure 4:
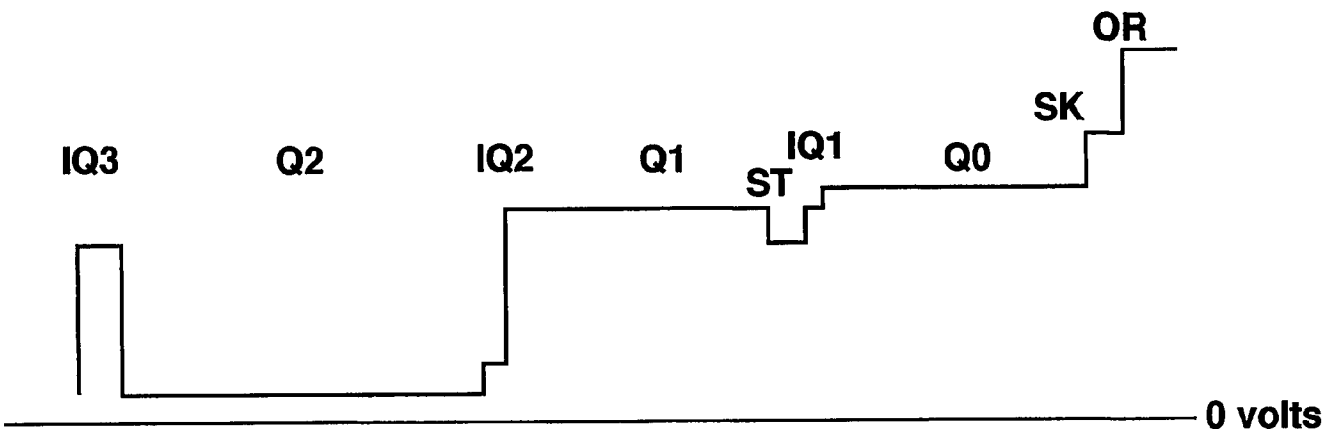
FIG. 4 is a graph, similar to FIG. 2, showing schematically voltage levels on lens elements, to cause movement of ions from the ion source through Q0 to Q2, with fragment ions stored in Q2.

The analysis is performed as follows:

Ions from the source 12 pass through Q0 into Q1 in known manner. The precursor m/z 609 is mass selected and transmitted through Q1, which is operated at unit mass resolution, and accelerated into Q2 where most of the m/z 609 ions are fragmented (as indicated in the spectrum of FIG. 3). By keeping the exit lens IQ3 of the collision cell at a voltage approximately 30V greater than that of the collision cell, all of the fragment ions can be stored in Q2. Typical voltages for this part of the analysis are: OR=150, SK=50, Q0=40, IQ1=39, ST=36, Q1=38, IQ2=15, Q2=11, IQ3=40. FIG. 4 shows in schematic form the voltages for each element between the orifice and the TOF mass spectrometer. After a selected time period, which may be a few milliseconds up to several hundred milliseconds, the ion beam is turned off by reducing the OR voltage so that no more ions enter Q0. At this point, all or the majority of the ions will have passed into Q2, where fragmentation will have occurred. Q2, due to the high potential at IQ3, will act as a trap holding the fragment ions.

Figure 5:
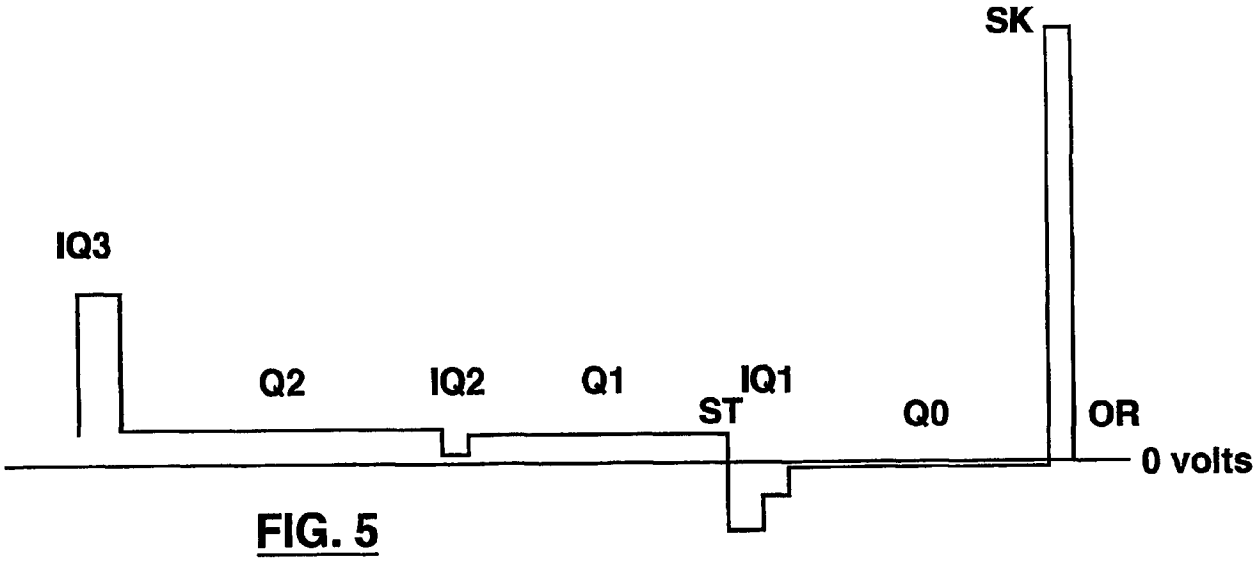
FIG. 5 is a graph, similar to FIG. 2, showing schematically voltage levels on lens elements, to cause movement of ions from Q2 back towards Q0.

Then Q1 is set to m/z 397, and all voltages are set to values which push the ions back toward Q0. Typical voltages for this part of the analysis are: OR=0, SK=100, Q0=0, IQ1=−6, ST=−10, Q1=8, IQ2=−5, Q2=11, IQ3=40. This is indicated in FIG. 5. Note that, unlike FIG. 4, there are no large potential drops, to keep ion energies low, to prevent or minimize fragmentation. These voltages move the ions back through Q1 into Q0, where they are trapped through collisions with the background gas. Since Q1 is set to m/z 397, only ions of m/z 397 survive and other ions are rejected. After this period (which may require tens of hundred of milliseconds if the ions are not forced by an axial electric field), Q0 contains only the m/z 397 products from m/z 609.

Finally, leaving Q1 set to m/z 397, the potentials are adjusted again to accelerate the ions back into Q2 where they fragment. Typical voltages for this step (to provide 39 eV collision energy for m/z 397) are: OR=0, SK=100, Q0=50, IQ1=49, ST=46, Q1=48, IQ2=0, Q2=11, IQ3=10, (as shown schematically in FIG. 6). This causes the trapped ions in Q0 to move back through Q1 and Q2 and then into the TOF 26. The m/z 397 ions fragment as they pass through Q2, and the resulting fragments or products are analyzed by the TOF 26.

Figure 6:
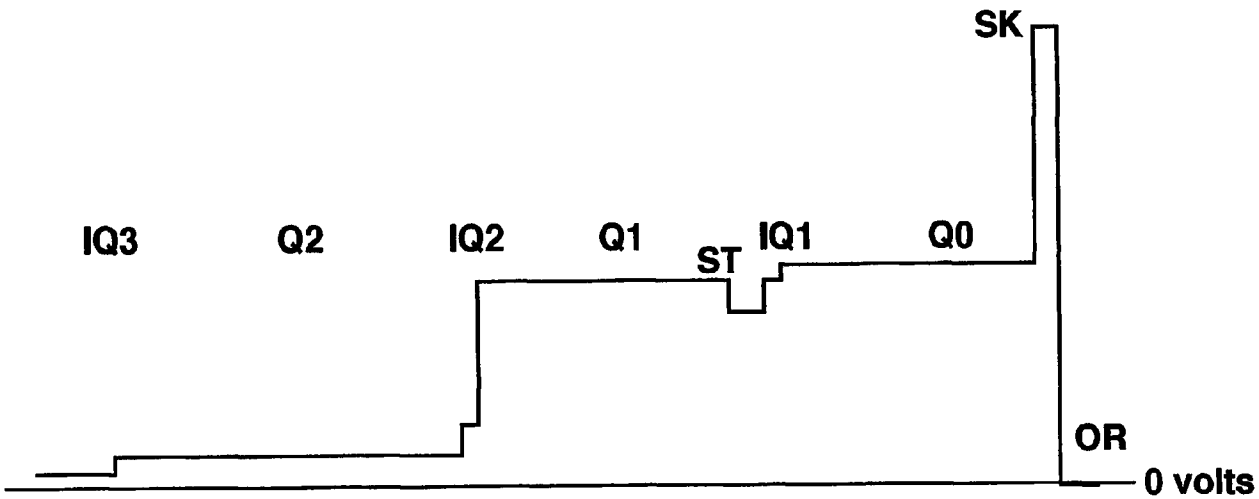
FIG. 6 is a graph, similar to FIG. 2, showing schematically voltage levels on lens elements, to cause movement of ions from Q0 into Q2 without transmitting ions from the ion source.
Figure 7:
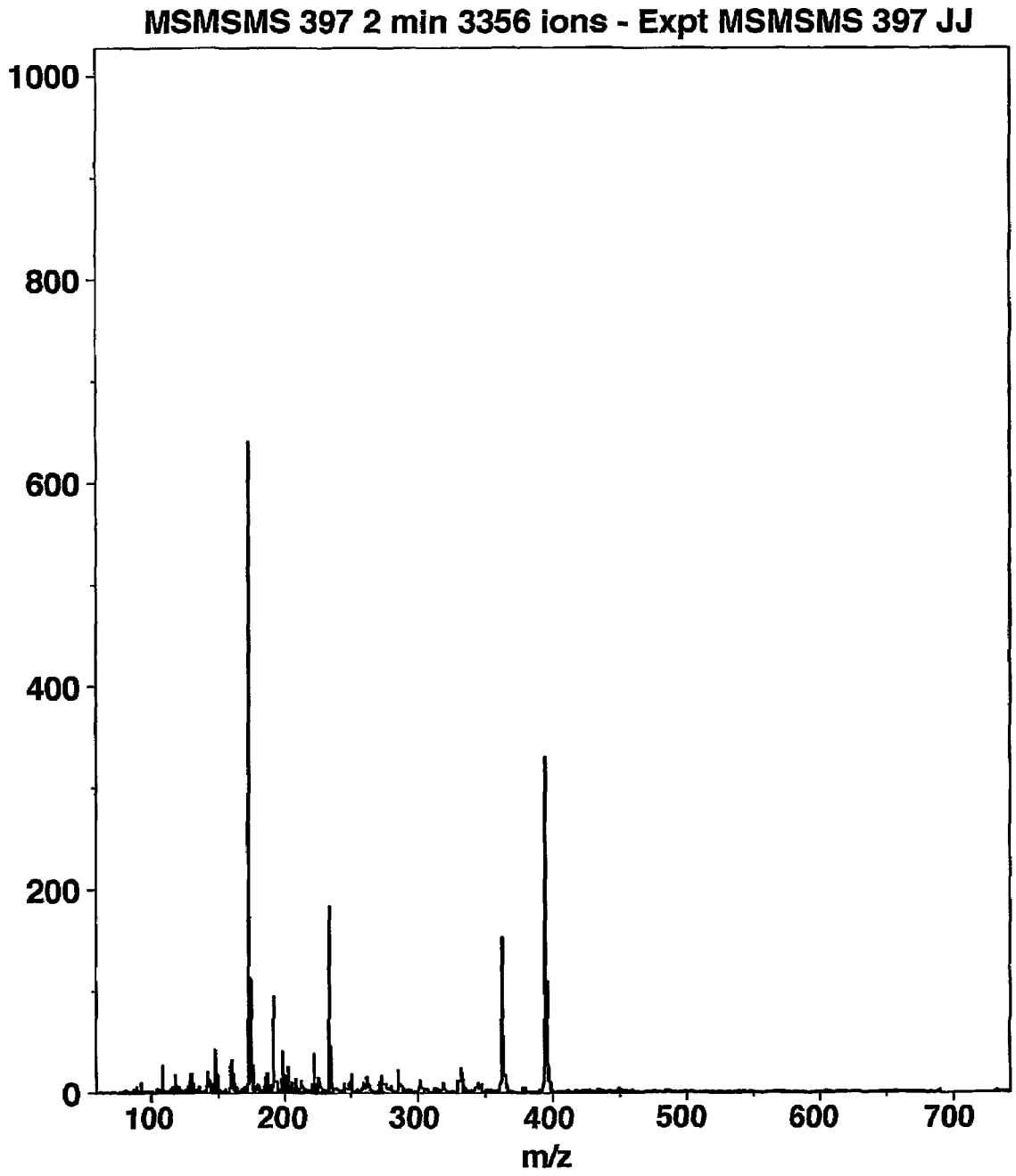
FIG. 7 is an MS/MS/MS spectrum for one fragment of reserpine.

FIG. 7 shows the MS/MS spectrum of m/z 397, (effectively, m/z 609 fragmented and selected to give m/z 397 and fragmentation of m/z 397) acquired as described under the experimental conditions described above. The mass resolution of Q1 during the period when ions are moved back into Q0 was set very low (a transmission window of which was wider than 10 amu), so that the transmission losses during this step should be low. When ions were moved back into Q2 for the second fragmentation step, Q1 was set to transmit m/z 397 with a transmission window about 2 amu wide. For the first step (FIG. 4), ions were trapped in Q2 for 966 millliseconds (ms). During the next 510 ms, ions were moved back to Q0 (FIG. 5). Then for 250 ms ions were allowed to flow from Q0 through Q2 and out to the TOF 26, while the TOF 26 was recording full scan spectra (FIG. 6). Finally, during 130 ms all voltages were reset to the condition ready to trap ions in Q2 again. This entire cycle was repeated over a time period of two minutes, and the resulting TOF spectra summed to give the spectrum in FIG. 7.

Note that in FIGS. 5 and 6 a low voltage was maintained at OR and a high voltage at the skimmer SK, to prevent further ions from the source entering the instrument. This can give an overall low duty cycle and this is discussed below. The efficiency can be calculated as follows: the total cycle time was 1.856 sec (0.96+0.51+0.25+0.13). The time during which ions were stored was 0.966 seconds, so that only 0.966/1.856=52% of the beam was sampled. In a separate experiment, the flux of m/z 397 from m/z 609 was measured as 50,276 ions in 120 seconds. The total number of ions recorded in FIG. 7 in 120 seconds was 3356 ions. Therefore the overall efficiency was therefore 3356/50276=6.7%. Correcting for the fact that the ion beam was only sampled for 52% of the time, the efficiency during the ion transfer and fragmentation steps is calculated as 6.7%/0.52=12.8%. This represents transmission losses through the Q1 going back into Q0 and then back to Q2, as well as any scattering losses during fragmentation.

This efficiency was improved upon in a later experiment where the resolution of Q1 was set even lower during the transfer back into Q0; the efficiency improved from 12.8% to 15%; however, transmission through Q1 at this low mass (397) should be about 35% at nearly unit mass resolution. It is expected that better optimization of the lens voltages, or the ion energies, could result in an overall efficiency of about 35% at unit mass resolution, and even better at lower resolution.

Figure 8:
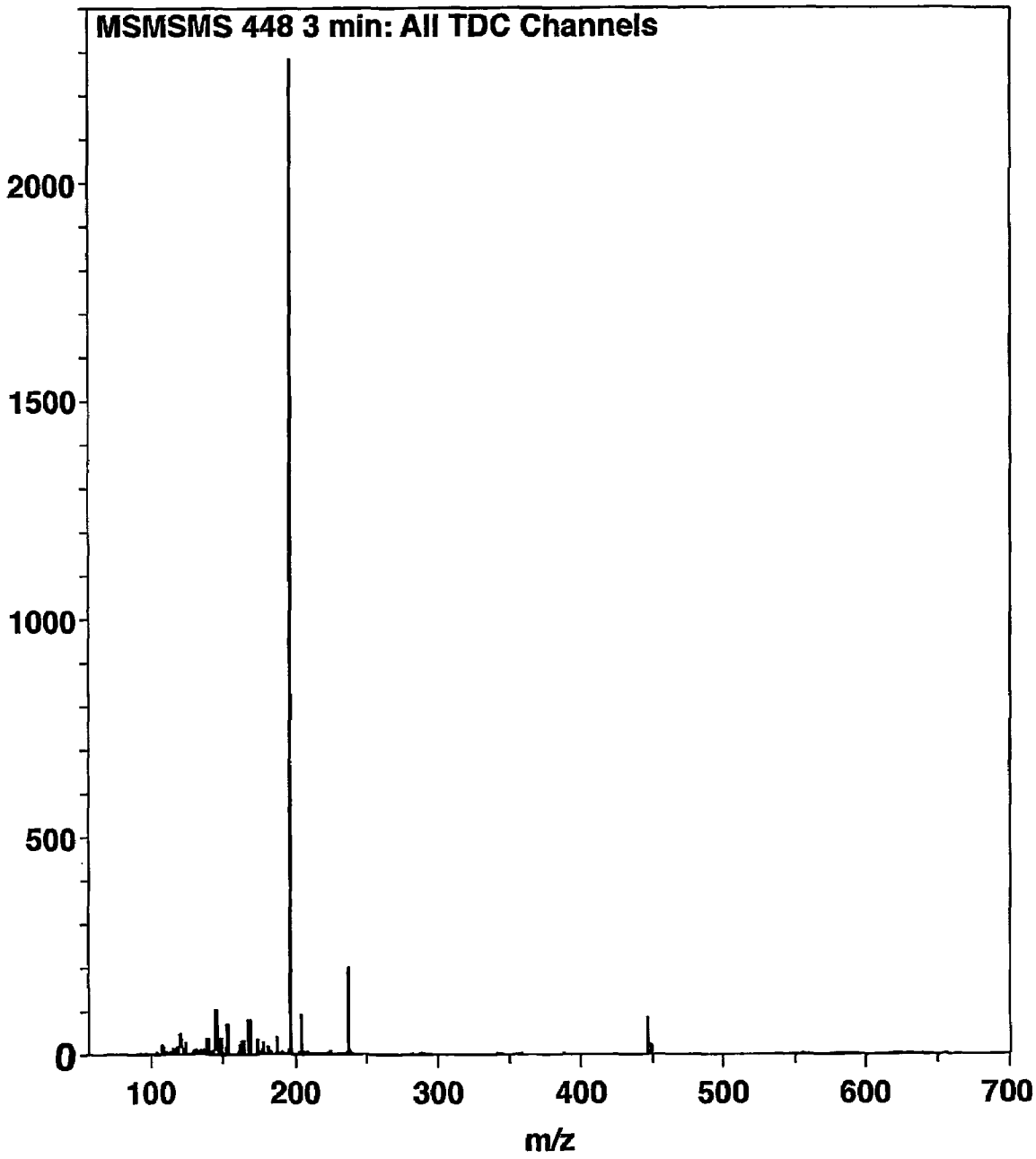
FIG. 8 is an MS/MS/MS spectrum for another fragment of reserpine.

FIG. 7 shows that the major fragments or products of m/z 397 are m/z 365, 233 and 174, but not m/z 195. FIG. 8 shows the MS/MS/MS spectrum of m/z 448 fragment derived from the m/z 609 ion. Here, the major fragment or product of m/z 448 is m/z 195, but not 174. This example shows the benefit of using MS/MS/MS to elucidate the sequential fragmentation pathways of a precursor ion such as m/z 609.

If it is desired to obtain the MS/MS spectrum of a fragment of m/z 397, the process can be extended by trapping the m/z 397 fragments or products in Q2, and sending them back through Q1 with Q1 tuned to the selected m/z (for example m/z 174). These fragment ions are then trapped in Q0, passed though Q1 for mass selection, and then re-accelerated into, Q2 to give an MS/MS/MS/MS spectrum. The process can be repeated as many times as desired, although some ion losses occur at each passage through Q1, so the signal-to-noise level decreases at each stage. However, if sufficient ion signal or sample is available, the MS″ process allows a hierarchy of structural information which can be useful in helping to determine the structure of a complex organic ion.

In the process of MS/MS/MS described above, the first generation fragment ion (i.e. m/z 397 in the example above) must pass through Q1 twice—once as the ions are returned to Q0, and then again as the ions are accelerated back into Q2 for fragmentation. Since there are losses in transmission associated with passing through a mass resolving quadrupole, it is advantageous if one of the "trips" or passes through Q1 be made with no resolving DC applied to Q1 (The instrument which was used to acquire the data shown in FIGS. 3, 7 and 8 did not allow this because of software limitations; however a simple change to the software should ideally allow the resolving DC to be set to 0 as described). For example, after the ions are trapped in Q2, the resolving DC voltage should be turned off for Q1, and then all of the fragment or product ions can be moved back into Q0. In fact, if Q1 is set to an RF voltage which will transmit m/z 397 (if resolving DC were also applied) during this stage, only ions which are greater in m/z than ⅞ of 397 (⅞* 397=308) will be transmitted into Q0, because in an RF-only mode, Q1 acts as a high pass filter, with a threshold of ⅞ of the mass value. After the ions (including at least all of the m/z 397) have been moved back into Q0, then the resolving DC can be turned back on in Q1, to give a desired resolution, in order to allow only m/z 397 to be selected and then accelerated back into Q2. In summary, all of the fragment or product ions of m/z 609 are trapped in Q2, then all of the ions greater than a selected m/z value (which is less than m/z 397) are moved at low energy back into Q0, and then only m/z 397 is accelerated back into Q2 and onward into the TOF.

In another variation of MS″, the ions could be fragmented during movement in both directions; in essence, this requires using Q0 as a collision cell, and conceptually one then has a collision cell/trap on both sides of the mass selecting quadrupole Q1. For example, after trapping all fragments or products in Q2, Q1 could be used to select m/z 397, and the ions could be accelerated into Q0, fragmenting through collisions with the gas in Q0. The fragments or products of m/z 397 would be trapped in Q0, Q1 would be set to m/z 174, and the ions then accelerated back through Q1 into Q2 and into the TOF. In this way, by moving the ions beam through Q1 into Q2, back into Q0, and then back through Q1 and out of Q2 again, using Q1 to select a next generation fragment or product at each stage, one level of MS/MS could be accomplished at each stage. This would make the process more efficient than effecting each stage of fragmentation only when ions enter Q2. One complication with this process is that in order to trap low mass fragment or product ions, the RF level on Q0 would have to be controlled so that it was set to a low value relative to that of Q1 when fragments are to be trapped in Q0. While in the current commercial QqTOF mass spectrometer system the Q0 voltage is a fixed fraction of the Q1 RF voltage as described previously, a separate Q0 power supply could be employed instead in order to provide independent control of the RF voltage on Q0.

A further consideration here is that the gas type and pressure in Q0 will not be as controllable as Q2. These parameters will be very dependent on gas flowing through the orifice in the skimmer SK. Nonetheless, a desired collision gas could be added to Q0 if the pressure or gas composition in this region were unsuitable for trapping or fragmenting ions as desired. The method of moving ions forward and backward through a mass resolving or RF-only quadrupole, and trapping in a high pressure quadrupole or multipole, provides capabilities for several other useful mode of operation in a tandem mass spectrometer.

The examples described above have been essentially examples of fragmentation, and for this reason reference above has been mainly to 'fragments' of precursor ions. However, the term 'product' has also been used to indicate that a pure fragmentation of the precursor is not essential. For example, instead of fragmenting the ions, they could undergo chemical reactions with neutral species in one of the high pressure quadrupoles. Adding a reagent gas could induce a specific ion molecule reaction in either Q0 or Q2, and the resulting product ion could be selected for further fragmentation or reaction. This also offers the possibility of effecting fragmentation in one of Q0, Q2 and reaction in the other of Q0, Q2. Additionally, it should be possible to change the gas in Q0 and/or Q2 while ions are in the other of the two traps formed by Q0 and Q2, to enable switching of the function of the respective quadrupole in the middle of an analysis sequence. For these various reasons reference is made in the claims and elsewhere to a 'product' and this term indicates either a fragment of a precursor formed by a collision process or a true product formed by chemical reaction of a precursor with a selected gas. It will also be realized that in some case the 'product' could be a fragment split of from the precursor that has also reacted with the ambient gas to form the product.

The same basic principle can be applied in a triple quadrupole tandem mass spectrometer (QqQ), in which two mass-resolving quadrupoles are separated by a collision cell. A Q0 ion guide is employed as a beam transport device into Q1, just as in the QqTOF configuration described above, but the TOF section is replaced by a further quadrupole commonly identified as Q3. If ions are trapped in Q2, the complete spectrum cannot be obtained when the ions are released in a pulse, because Q3 cannot scan quickly enough. However, Q3 can be used to monitor one or two specific ions during the release pulse. Thus, the process of MS/MS/MS (or MS″) can be performed by following the same steps as described for the QqTOF, except that only one ion would be monitored by Q3 when the higher generation product ions are released from Q2. In the example of m/z 609 given above, Q3 could be used to monitor the intensity of m/z 174 (the product of m/z 397, itself a product of 609). This mode of operation is similar to the MRM mode in a triple quadrupole, except that two stages of MS/MS are employed. The advantage of this technique is that it would be more specific than the normal MRM mode, since only compounds with the correct precursor ion, first generation product and second generation product (609/397/174) would be detected. The higher specificity would make this mode useful in the quantitative analysis of very dirty or complex samples.

Although both Q0 and Q2 have been referred to as quadrupoles, it will be understood that any other radio-frequency multipole or ion guide (such as a hexapole, octapole, or even an RF ring guide) could be used for the same purpose, since all of these devices can be used to trap and cool ions.

One of the unique features of the present invention is that the ion beam is reversed in direction. After trapping in Q2, the ions are reversed and moved back into Q0. In order to move ions quickly through a high pressure multipole, it is known to use an axial field such as that described in U.S. Pat. No. 5,847,386. Normally, the axial field is used to drive or move ions in one direction only. However, in the spectrometer device described in this application, it would be useful to apply an axial field in Q2 directed back toward Q1 during the process of moving ions from Q2 back to Q0, and then apply an axial field in the forward direction during the last stage of moving ions through Q2 to the TOF 26 or into 03 for the triple quadrupole tandem mass spectrometer. An axial field could also be used in Q0 in order to help drive ions toward Q2 during the second fragmentation stage, and generally in order to more rapidly empty Q0 during any stage as the relatively high pressure present can delay emptying of Q0 (e.g. during the initial fill stage in order to ensure that all ions are moved quickly into Q2 after the ion beam is turned off). Thus a controlled axial field, applied in the direction in which it is desired to move the ions, in any element of the device, could be advantageously used in order to speed the transfer process, and make the complete process more efficient in time. This can be accomplished with various configurations of axial field multipole as described in the above patent, including the use of tilted rods, auxiliary electrodes between the rods or segmented electrodes, all of which have the advantage that the direction of the axial field can be reversed by changing one voltage only.

The entire process of filling Q2, sending the ions back to Q0, then back to Q2 and out to the TOF section 26 or Q3, may require several tens to hundred of milliseconds (although the use of an axial field as described above could shorten the transfer steps considerably). After filling Q2, the ion beam is switched off (or deflected) by biasing OR and SK as described above. The ions which enter the vacuum system from the ion source are therefore wasted during the time after the fill step. In order to improve the efficiency, another embodiment of the present invention provides an additional trapping device in front of Q0 (between SK and Q0). This trapping device could be another RF multipole device, separated from Q0 by an aperture lens or by another short RF multipole which would act as a gate. This configuration is shown in FIG. 9.

Figure 9:
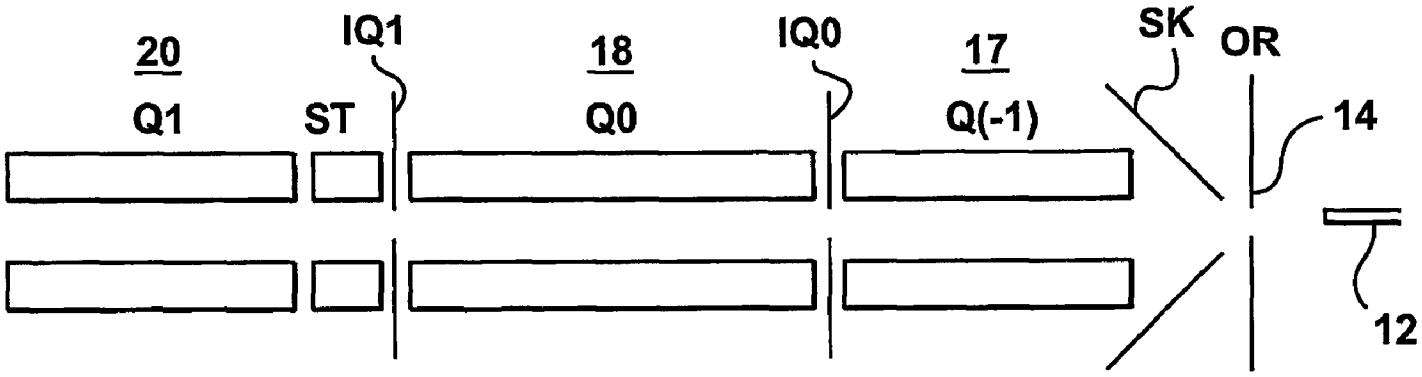
FIG. 9 shows a variation of the inlet portion of a spectrometer, including an additional RF multipole for trapping ions.

For simplicity and brevity, like components in FIG. 9 are given the same reference numeral as in earlier Figures. The description of these components is not repeated. Here an additional quadrupole rod set is provided upstream of Q0, and for consistency with the previous numbering scheme, is identified as Q(-1). Q(-1) is separated from Q0 by a further interquad aperture IQ0, the designation again being selected for consistency. Q(-1) is therefore located in an initial vacuum chamber 17 which as for the first vacuum chamber 18 in FIG. 1 would be maintained at a pressure of 10−2 Torr. As the chamber 18 is now further separated from the upstream higher pressure chamber 17, there is greater freedom to select a pressure for the first vacuum chamber 18 and to control the gas in chamber 18. More specifically, it should be easier to operate Q0 and the chamber 18 as a collision cell, similar to the collision cell 24 including Q2 as shown in FIG. 1. After Q2 is filled, additional ions from the source 12 are trapped in this multipole (referred to as Q(-1)) while the ions in Q2 are processed by $MS^{nth}$, transferring between Q2 and Q0 as described in the previous sections. After processing the ions for the MS/MS/MS steps, the accumulated ions could be transferred from Q(-1) through Q0 and into Q2 for another analysis. In this scheme, no ions are wasted, and up to 100% of the ion beam is used. The trapping volume (i.e. length and depth of the trapping potential) and conditions (i.e. q-value) would need to be selected in order that all ions (in the mass range desired) would be trapped in Q(-1) without overfilling the device. However, even if not 100% efficient, there should be some significantly improved sensitivity achieved from this trapping section. In order to reduce the space charge problem, some method of mass selection (such as a filtered noise field or swept auxiliary frequency) could be used in order to reject un-wanted ions, or ions within a certain mass range. Such techniques are well known, and described for example by Douglas in U.S. Pat. No. 5,179,278.

In another implementation of the basic process of reversing the direction of ion flow in order to accomplish $MS^{nth}$ in a linear quadrupole configuration, the linear ion trap described in co-pending U.S. application Ser. No. 09/087,909, by James Hager mentioned above may be employed in the following fashion. In place of the TOF mass spectrometer after the collision cell, or in place of the RF/DC quadrupole after the collision cell, a linear ion trap is used for the final mass analysis step. As in the methods described above, ions are selected by Q1, trapped in Q2, moved back through Q1 into Q0, and then back through Q1 and Q2 for final mass analysis of the second generation products. In this embodiment, the ions are trapped in Q3 which is operated as a linear ion trap, and ions are scanned out of Q3 using methods which are described in the copending Hager application. This provides the same basic capabilities of full scan MS/MS/MS as is proved in the case of the QqTOF system as described in the embodiments mentioned earlier.

In another related method, first generation product ions could be trapped in Q3 instead of Q2. Well known radial excitation methods such as described in the Douglas PCT application can be used to isolate a particular first generation product. Then, the selected product can be accelerated back into Q2 for fragmentation, and the products trapped in Q2. The resulting products can be moved back into Q3 where they are trapped again, and then scanned out of Q3 in the known fashion to produce a mass spectrum of the second generation fragments.

In another implementation of the basic process, the reversal of direction of ion flow can be used to accomplish MS/MS on an instrument which is configured to do MS only. Such a configuration is shown in FIG. 10, and as in earlier Figures, for simplicity the same reference numerals are used where possible.

Figure 10:
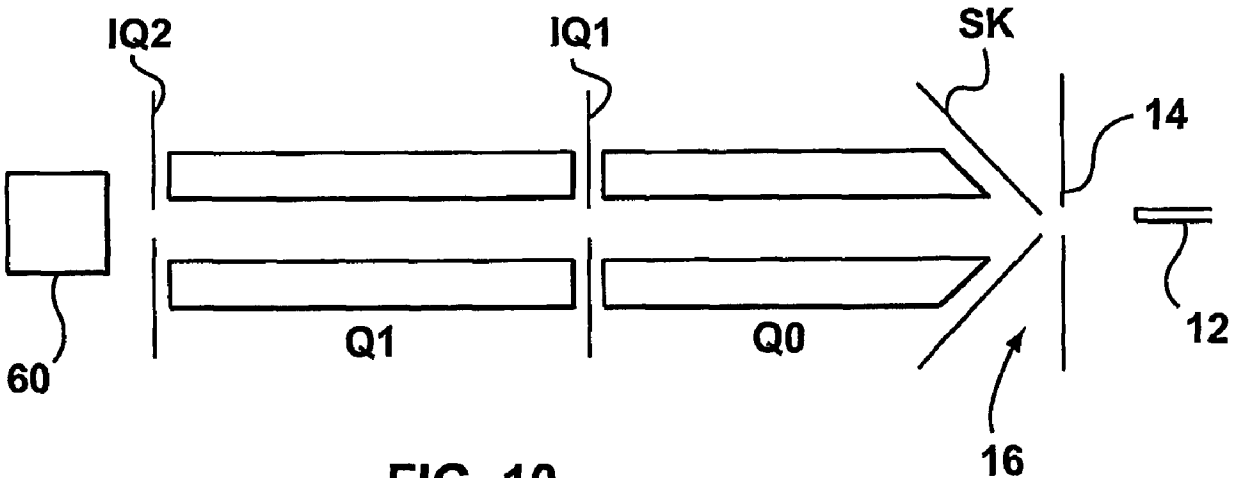
FIG. 10 is a schematic view of another spectrometer configuration for use in the present invention.

FIG. 10 shows a single MS instrument which consists of an ion source 12, an interface 16, Q0 (RF-only quadrupole) and Q1 (mass resolving quadrupole). A detector 60 is provided at the output in known manner. Such an instrument is manufactured and sold as an API 150 by Applied Biosystems/MDS Sciex, for example. In conventional operation, this instrument is only used for MS analysis, with no possibility of doing MS/MS, because there is only one mass resolving quadrupole, and there is no collision cell. However, in accordance with the present invention, the method of reversing the direction of ion motion allows this instrument to be operated in an MS/MS mode as follows:

Ions from the ion source, after passing through Q0, are trapped in Q1 by raising the voltage on the lens IQ2 at the exit from Q1. After a trapping period, set to allow accumulation of a desired quantity of ions, ion flow into Q0 is turned off by reversing the electric field in front of Q0. Under typical operating pressure of 1–3×10−5 torr in Q1, a large portion of ions will remain trapped in Q1. Isolation of a precursor ion can be performed by using techniques such as a tailored quadrupolar or dipolar waveform applied to Q1 in order to excite and eject all m/z values except the one of interest, or by using RF-only isolation at low and high q-value. After isolating a precursor ion of interest, it is accelerated back into Q0 (which is now empty of ions) by making the offset voltage on Q1 more positive than that on Q0. Ions undergo collisions with the background gas in Q0 which flows in through the skimmer, and product ions are formed in the collisions and trapped in Q0. After all of the ions are transferred into Q0, they can be re-introduced into Q1 by reversing the potential difference between Q0 and Q1 (i.e. to re-establish the original potential gradient), and moving ions back into Q1 where they are trapped again. By using methods described in the Hager application 09/087, 909 (and equivalent published PCT application WO99/63578) mentioned above, ions can be scanned out of Q1 for mass analysis. This sequence provides MS/MS operation with precursor ion selection or isolation, fragmentation in an RF-only quadrupole, and then mass analysis of the fragments. By repeating the process, higher orders of MS3, MS4 are possible. As FIG. 10 shows, only a single MS configuration is required.

The invention claimed is:

1. A method of analyzing ions, the method comprising:

(i) providing a stream of ions;

(ii) passing the ions along an ion path including a first mass selector, for selecting precursor ions and a collision cell for effecting one of fragmentation of the precursor ions and reaction of the precursor ions with a reaction gas, thereby to form product ions; and (iii) mass analyzing the product ions, wherein the method includes: reversing the direction of ion flow along the ion path, to cause the ions to pass into at least one of the first mass selector and the collision cell more than once, thereby effecting multiple steps of at least one of forming products ions and mass analyzing the product ions.

2. A method as claimed in claim 1, which includes:

(a) first passing ions through a RF ion guide and operating the RF ion guide at a relatively high pressure;

(b) passing the ions into said mass selector for selection of said precursor ions;

(c) passing the ions back in the RF ion guide and causing the RF ion guide to function as said collision cell to effect one of fragmentation and reaction of said precursor ions to form said product ions; and (d) passing the product ions back into the mass selector for a final mass analysis step.

3. A method of analyzing ions as claimed in claim 1, the method further comprising:

(a) subjecting the ions to a first mass selection step in said first mass selector, to select precursor ions;

(b) passing the precursor ions into said collision cell, to effect said one of fragmentation of the precursor ion and reaction of the precursor ion with the reaction gas, thereby to form said product ions;

(c) passing said product ions back into the first mass selector, and operating the mass selector to select desired product ions;

(d) passing the selected product ions back into the collision cell to effect at least one of fragmentation of the selected product ions and reaction of the selected product ions with the gas, thereby to form secondary product ions; and (e) effecting a final mass analysis step on the secondary product ions.

4. A method as claimed in claim 2, wherein the final mass analysis step is effected in the first mass selector.

5. A method as claimed in claim 3, wherein the final mass analysis step (e) is effected in a mass analyzer separate from the first mass selector.

6. A method as claimed in claim 4, wherein the final mass analysis step (e) is effected in one of a time-of-flight instrument to provide a complete mass spectrum, a linear ion trap to provide a complete mass spectrum, and a mass filter providing detection of one or more selected masses.

7. A method as claimed in claim 3, which includes providing a first ion trap, passing the ions through the first ion trap into the first mass selector, and, in step (c), passing the product ions back through the first mass selector into the first ion trap, and then passing the product ions from the first ion trap through the first mass selector into the collision cell.

8. A method as claimed in claim 7, which includes, when passing the product ions back through the first mass selector into the first ion trap, setting the first mass selector with a very low resolution, to transmit substantially all the ions in a window around the selected mass, and, when passing the product ions from the first ion trap through the first mass selector to the collision cell, setting the first mass selector to select only a narrow mass range around said selected product ion.

9. A method as claimed in claim 7 or 8, which includes providing the first ion trap, the first mass selector and the collision cell with first, second and third quadrupole rod sets respectively, axially aligned with one another.

10. A method as claimed in claim 7 or 8, which includes providing each of the first ion trap and collision cell as one of RF multipoles and RF ring guides.

11. A method as claimed in claim 9, which includes maintaining pressures of the order of 10 milliTorr in the first and third quadrupole rod sets and a pressure of substantially 10−5 Torr in the second quadrupole rod set providing the first mass selector.

12. A method as claimed in claim 11, which includes at least one of: supplying one of a collision gas and a reaction gas to the first ion trap; and supplying one of a collision gas and a reaction gas to the collision cell.

13. A method as claimed in claim 7, which includes in steps (a) and (b) providing a DC axial electric field within the collision cell to drive ions in a first direction and providing a potential at an exit of the collision cell to trap product ions therein; and during step (c) providing an axial electric field to drive ions back out of the collision cell through the first mass selector to the first ion trap, while providing a potential between the first ion trap and the ion source to prevent further ions from the ion source entering the first ion trap; during at least step (d) maintaining an axial electric field in the collision cell to drive ions from the collision cell into the final mass analyzer.

14. A method as claimed in claim 13, which includes in step (c) maintaining a potential gradient that does not significantly accelerate the ions, thereby to prevent at least one of unwanted fragmentation and reaction of ions during passage back to the first ion trap; and in step (d) accelerating the ions into the collision cell with sufficient energy to promote at least one of fragmentation and reaction of the product ions.

15. A method as claimed in claims 7, 13 or 14, which includes providing a RF multipole or RF ring guide as the first ion trap, and a further, RF multipole or RF ring guide for storing ions upstream of the first ion trap.

16. A mass spectrometer apparatus, for analyzing ions and comprising:

(i) an ion source;

(ii) a first mass selector, for receiving ions from the ion source and for selecting a precursor ion;

(iii) a collision cell connected to the first mass selector, for receiving a precursor ion, and for effecting at least one of fragmentation and reaction of the precursor ion to generate product ions; and (iv) a DC power supply connected to at least the collision cell and the first mass selector, and adapted to provide potentials to generate an axial field for: driving ions from the first mass selector into the collision cell; and driving ions from the collision cell back into the first mass selector.

17. A mass spectrometer apparatus as claimed in claim 16, which includes a final mass analyzer, for receiving ions from the collision cell for final analysis.

18. A mass spectrometer apparatus as claimed in claim 17, wherein the final mass analyzer comprises one of a time-of-flight mass spectrometer section, a linear ion trap and a quadrupole mass analyzer provided with a detector.

19. A mass spectrometer apparatus as claimed in claim 18, which includes a first ion trap, provided between the ion source and the first mass selector, wherein interquad apertures are provided between the first ion trap and the first mass selector, between the first mass selector and the collision cell, and between the collision cell and the final mass analyzer, and wherein the power supply is connected to all of the said interquad apertures and to the ion trap, the first mass selector, the collision cell and the final mass analyzer.

20. A mass spectrometer apparatus as claimed in claim 16, 17, 18 or 19, which includes an initial ion trap between the first ion trap and the ion source, for storing ions from the ion source, while other ions are being analyzed in the remainder of the apparatus.

21. A mass spectrometer apparatus as claimed in claim 20, wherein each of the initial ion trap, the first ion trap, the first mass selector and the collision cell includes a respective quadrupole rod set, all axially aligned with one another.

22. A mass spectrometer apparatus as claimed in claim 16, which includes an RF ion guide located between the ion source and the first mass selector, the RF ion guide being operable as an intermediate pressure section and being connected to the DC power supply for operation as a collision cell for ions received back from the first mass selector.

23. A method of analyzing ions, the method comprising:

a) providing a stream of ions;

b) directing the stream of ions to a mass selector for selecting precursor ions;

c) directing a selected one or a selected range of precursor ions to a collision cell and effecting one of fragmentation of the precursor ions and reaction of the precursor ions with a reaction gas to form product ions thereof;

d) directing the product ions to said mass selector; and e) mass analyzing the product ions.

24. A method according to claim 23, further comprising in place of step e) and after step d):

f) directing a selected one or a selected range of product ions to said collision cell and effecting one of fragmentation of the product ions and reaction of the product ions with a reaction gas to form next generation product ions thereof;

g) directing the next generation product ions to said mass selector; and h) repeating the process of steps f), and g) and after the desired $MS^n$ is obtained performing a final mass analysis.

25. A method according to claim 23, wherein said mass selector and said collision cell define an ion path and the step of directing the selected one or the selected range of precursor ions to said collision cell is caused by reversing the direction of ion flow along the flow path.

26. A method according to claim 23, wherein said mass selector and said collision cell define an ion path and the step of directing the product ions to said mass selector is caused by reversing the direction of ion flow along the flow path.

27. A method according to claim 24, wherein said mass selector and said collision cell define an ion path and the step of directing the selected one or the selected range of product ions to said collision cell is caused by reversing the direction of ion flow along the flow path.

28. A method according to claim 27, wherein the step of directing the next generation product ions to said mass selector is caused by reversing the direction of ion flow along the flow path.

29. A method according to claim 24, wherein said mass selector and said collision cell define an ion path and the step of directing the next generation product ions to said mass selector is caused by reversing the direction of ion flow along the flow path.

30. A method according to claims 25, 26, 27, 28, or 29, wherein the ions are trapped before reversing direction of the ion flow along the flow path.

31. A method according to claims 23 or 24, wherein said collision cell is an RF-only ion guide.

32. A method according to claims 23 or 24, wherein said mass selector is one of a quadrupole, a time-of-flight instrument, an ion trap, and a FTMS mass spectrometer.

33. A method according to claims 23 or 24, wherein the final mass analysis occurs in a mass analyzer separate from said mass selector.

34. A method according to claim 33, wherein the mass analyzer is one of a time-of-flight instrument, a linear ion trap, and a mass filter.

35. A method according to claims 27, 28 or 29, wherein an RF ion guide is provided on the ion path adjacent said collision cell on one side thereof and said mass selector is adjacent said collision cell on the other side thereof, said RF ion guide to trap ions from a source of the stream of ions while steps f) and g) are repeated by said mass selector and collision cell to produce the desired $MS^n$.

36. A method according to claims 27, 28 or 29, wherein an RF ion guide is provided on the ion path adjacent said mass selector on one side thereof and said collision cell is adjacent said mass selector on the other side thereof, said RF ion guide to trap at least one of the product ions and the next generation product ions before at least one of steps d) and g), respectively.

37. A method according to claims 27, 28 or 29, wherein in at least one of steps c) and f) said collision cell traps at least one of the respective product ions and next generation product ions.

38. A method according to claim 36, wherein in at least one of steps c) and f) said collision cell traps at least one of the respective product ions and next generation product ions.

39. A method according to claim 35, wherein said mass selector is operated in a transmission mode when said RF ion guide to trap one of the respective product ions and next generation product ions.

40. A method according to claim 36, wherein said mass selector is operated in a transmission mode when said RF ion guide to trap one of the respective product ions and next generation product ions.

41. A method according to claim 37, wherein said mass selector is operated in a transmission mode when said RF ion guide to trap one of the respective product ions and next generation product ions.

42. A method of analyzing ions, the method comprising:

a) providing a stream of ions;

b) directing the stream of ions through an RF ion guide into a mass selector;

c) directing a selected one or a selected range of precursor ions into a collision cell to form product ions;

d) trapping said product ions in said collision cell;

e) directing said product ions back through said mass selector into said RF-only ion guide;

f) directing a selected one or a selected range of product ions into said collision cell to form next generation product ions; and g) mass analyzing the next generation product ions.

43. A method according to claim 42, wherein the direction of ion flow is reversed at least once during the analysis.

44. A method according to claim 42, wherein at least one of said RF-only ion guide and collision cell are configured to have an axial field, said axial field causing the direction of ion flow to reverse during the analysis.

45. A method according to claim 42, further comprising after step f) trapping next generation product ions in said collision cell and repeating steps e) and f) to obtain the desired $MS^n$.

46. A method according to claims 42 or 45, wherein said mass selector is set to select one or a range of said product ions in step e).

47. A method according to claim 46 wherein ions are fragmented in said RF-only ion guide in step e).

48. A method of analyzing ions, the method comprising:

a) providing a stream of ions;

b) directing the stream of ions through an RF ion guide into a mass selector;

c) directing a selected one or a selected range of precursor ions into a collision cell to form product ions;

d) directing the product ions into a linear ion trap to trap said product ions;

e) directing a selected one or a selected range of product ions into said collision cell for form next generation product ions; and f) mass analyzing said next generation product ions.

49. A method according to claim 48, wherein step f) is performed by said linear ion trap.

50. A mass spectrometer apparatus, comprising:

(i) an ion source;

(ii) a first mass selector to receive ions from the ion source, the first mass selector to select a precursor ion;

(iii) a collision cell to receive a precursor ion, the collision cell to effect at least one of fragmentation and reaction of the precursor ion to generate product ions; and (iv) a DC power supply connected to at least the collision cell and the first mass selector, the DC power supply adapted to provide potentials suitable to drive the ions from the collision cell back toward the mass selector.

51. A mass spectrometer apparatus according to claim 50, wherein the DC power supply is adapted to provide potentials suitable to allow the ions to travel from or through the mass selector back toward the collision cell.

52. A mass spectrometer apparatus, comprising:

(i) an ion source;

(ii) a first mass selector to receive ions from the ion source, the first mass selector to select a precursor ion;

(iii) a first RF-only ion guide to transmit ions toward said mass selector;

(iv) a collision cell to receive a precursor ion, the collision cell to effect at least one of fragmentation and reaction of the precursor ion to generate product ions; and (v) a DC power supply connected to at least the collision cell and the RF-only ion guide, the DC power supply adapted to provide potentials suitable to change the direction of flow of the ions.

* * * * *